United States Patent [19]

Gronvall

[11] 4,179,891

[45] Dec. 25, 1979

[54] POWER CONTROL DEVICE FOR HOT GAS ENGINES

[75] Inventor: Karl O. R. Gronvall, Borensberg, Sweden

[73] Assignee: Forenade Fabriksverken, Eskilstuna, Sweden

[21] Appl. No.: 895,586

[22] Filed: Apr. 12, 1978

[30] Foreign Application Priority Data

May 7, 1977 [SE] Sweden ..... 7707767

[51] Int. Cl.[2] ..... F02G 1/06

[52] U.S. Cl. ..... 60/521

[58] Field of Search ..... 60/521, 522; 62/6

[56] References Cited

U.S. PATENT DOCUMENTS 3,999,388 12/1976 Nystrom ..... 60/521

*Primary Examiner*—Allen M. Ostrager

*Attorney, Agent, or Firm*—Laurence R. Brown

[57] ABSTRACT

A hot gas engine is run at constant speed and power output controlled by the supply of working gas. Former such systems are simplified both in the number of control valves necessary and in the conduit system array by providing an engine speed controlled solenoid check valve to control a gas compressor suction stroke alternately (a) at normal speeds for free flow in both directions or (b) at higher speeds showing an excess of power to admit working gas from the engine to the compressor for pumping into a working gas reservoir. One embodiment provides hydraulic control from an oil supply with pressure dependent on engine speed of a short circuiting solenoid which upon a sudden burst of engine speed when the load is removed establishes equal gas pressure on both sides of the engine piston.

4 Claims, 3 Drawing Figures

POWER CONTROL DEVICE FOR HOT GAS ENGINES

BACKGROUND OF THE INVENTION

Figure 1:
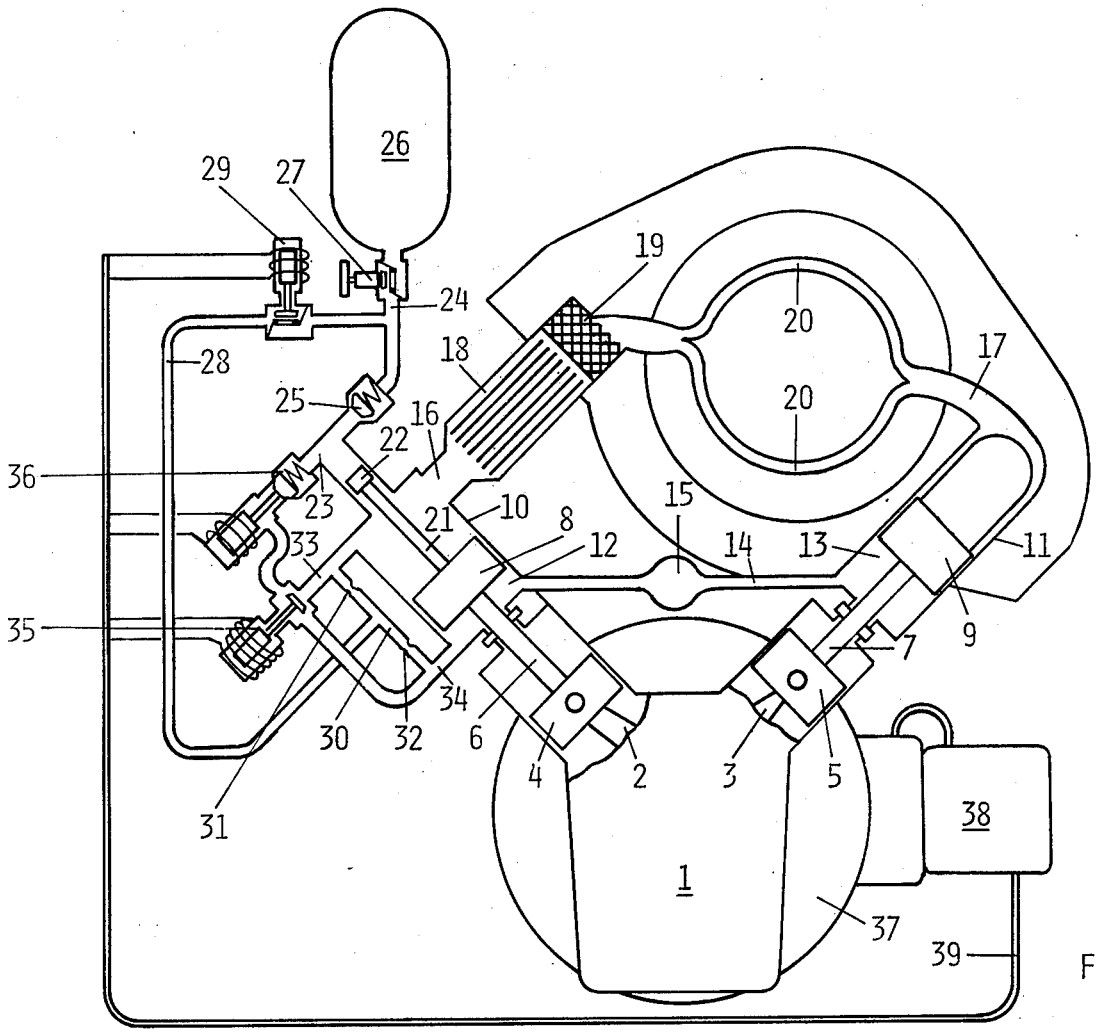

This invention relates to a power control device for hot gas engines of the type adapted to maintain a predetermined engine speed regardless of the power output and in which the power output is controlled by varying the amount of working gas in the engine, said device comprising a generator, an electronic unit providing an output signal in dependence of the difference between the desired and the actual engine speed, solenoid valves governing the amount of working gas in the engine, and a compressor and a reservoir for working gas. A power control device of this type has been described e.g. in the U.S. Pat. No. 3,999,388.

In principle such device operates the way that in case of need for more power a solenoid valve opens a conduit from the reservoir to the working gas spaces of the engine. In case of reduced need for power a connection from the pressure side of the compressor to the reservoir is opened while a check valve ensures that the flow of gas only can be effected in this direction. In case the load on the engine should cease completely the working gas spaces of the engine are short circuited causing the power output to stop.

In the known power control system a greater number of solenoid valves, check valves and gas conduits are used. The object of the present invention is to provide a simpler, cheaper and more reliable system which consumes less power.

BRIEF DESCRIPTION OF THE INVENTION

According to the present invention this is obtained thereby that a check valve allowing flow in the direction towards the compressor and having a solenoid governed device enabling it to open also in the opposite direction has been arranged in a conduit connecting the working space of the compressor with the working gas spaces of the engine. Hereby it is obtained that three valve functions of the known control device may be replaced by a single valve resulting in a simpler tubing and in a complete release of the compressor during periods of constant power output.

THE DRAWING

Figure 2:
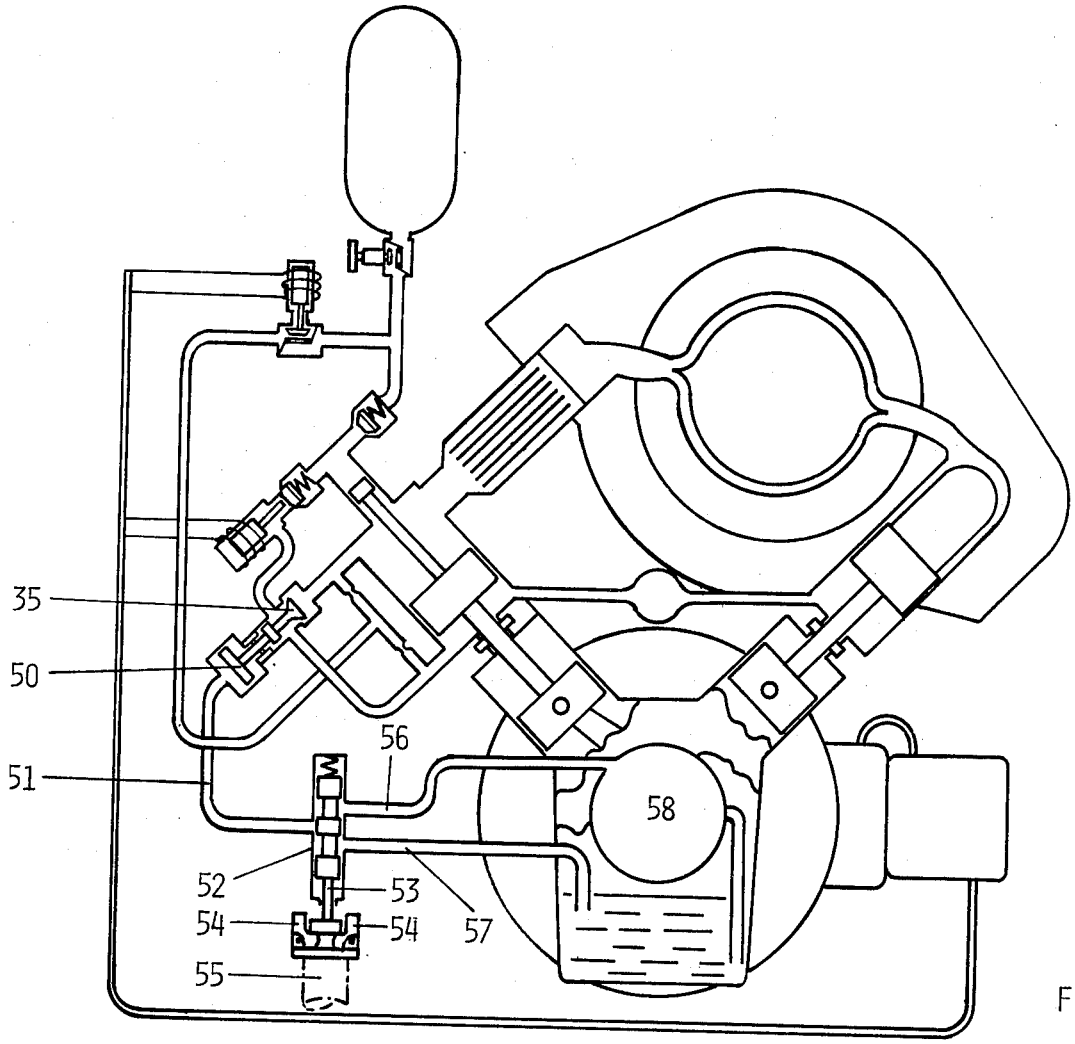
Figure 3:
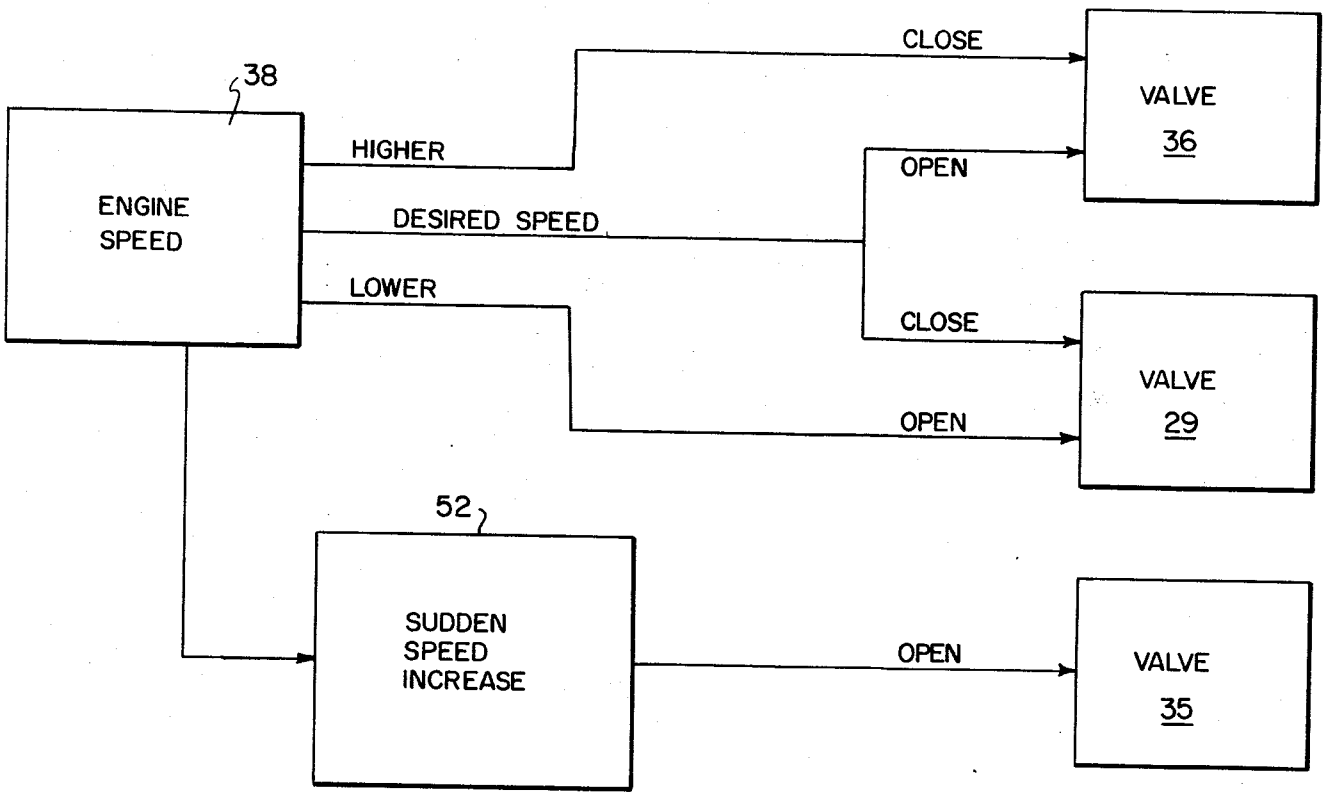

The invention will be described in more detail reference being made to the drawing in which FIGS. 1 and 2 schematically show vertical sections through two different power control devices according to the invention, and FIG. 3 shows a control system block diagram.

The engine shown in FIG. 1 comprises a crank casing 1 containing a crank shaft (not shown). Said crank shaft is influenced by connecting rods 2, 3 connected to cross-heads 4, 5. These are in turn connected to piston rods 6, 7 and pistons 8, 9 movably arranged in cylinders 10, 11. The two cylinder spaces 16, 17 above the pistons 8 and 9 are interconnected via a cooler 18, a regenerator 19 and a number of heater tubes 20, only two of which are shown and located close to a combustion chamber (not shown).

An extension of the piston rod 6 beyond the piston 8 forms a compressor piston rod 21, provided with a compressor piston 22 working in a cylinder 23. A conduit 24 containing a check valve 25 connects the compressor cylinder 23 with a reservoir 26 for working gas—e.g. helium. A manually operable valve 27 has also been inserted in the conduit 24.

A conduit 28, which is branched off from the conduit 24 is provided with a solenoid valve 29 and leads to a conduit 30 between two restrictions 31 and 32 in said conduit 30, which connects a conduit 33 communicating with the upper end of the cylinder 10 and a conduit 34 communicating with the lower end of the cylinder 10. The conduits 33 and 34 are also communicating with each other via a solenoid valve 35. Furthermore, the conduit 34 is connected to a solenoid governed check valve 36 which connects the conduit 34 to the suction side of the compressor cylinder 23. The solenoid may keep the valve 36 open for flow in both directions. If the valve 36 is not influenced by the solenoid it will allow flow of gas only in the direction towards the compressor cylinder 23.

A generator 37 powered by the engine will provide a voltage which is supplied to an electronic unit 38, which will give an output signal through a wire 39 in proportion to the difference between the actual and the desired speed of the engine. Said signal will govern the valves 29, 35 and 36.

The engine shown in FIG. 1 and described above will be power controlled as follows:

The connecting rods 2 and 3 are journalled on a common crank bearing on the crank shaft (not shown). The cylinders 10 and 11 are perpendicular to each other and thus the pistons 8 and 9 will move in the cylinders at 90 degrees phase difference. The amount of gas in the two cylinder spaces 16 and 17 and in the cooler 18, the regenerator 19 and the heater tubes 20 will alternatively be compressed mainly in the cylinder space 16 at a low temperature and be expanded in the cylinder space 17 at a high temperature.

If the engine is running at desired speed the valve 29 will receive such signal that it is kept in the closed position. The valve 36 will be kept fully open by the solenoid and the valve 35 will be kept closed. The amount of working gas in the engine will not be changed and the gas pressures are equal at both sides of the piston 22 which therefore will not do any work.

In the case the engine is to increase its output—an indication of which being that the speed of the engine has become lower than the desired engine speed—the valve 29 will receive a signal to open. Provided that the manual valve 27 is open during the whole working period of the engine gas will now flow from the reservoir 26 to the conduit 30 and into all the cylinder spaces 12, 13, 16 and 17. The engine will now work with greater gas amounts and the power output will increase until the desired speed has been obtained. The valve 29 will then close again.

In case the power output should decrease—i.e., in case the obtained speed is greater than the desired speed—the electronic unit 38 will give such signal that the solenoid at the valve 36 does not influence it to open. The piston 22 will then start to pump gas from the conduit 34—and thus from all spaces of the engine containing working gas—to the reservoir 26. The power output of the engine will decrease in proportion to the decreasing pressure of the working gas and the engine speed will decrease. As soon as the desired speed is obtained the solenoid of the valve 36 will receive a signal to open again causing the pumping of working gas to the reservoir to cease.

In case the engine speed suddenly increases substantially —e.g. because the engine is suddenly released from any load—the electronic unit 38 will give an opening signal to the valve 35. This will cause an equalizing of the pressures at both sides of the piston 8 and consequently even at both sides of the piston 9. The engine, therefore, cannot give any power and the speed will decrease.

The two spaces 12 and 13 under the pistons 8 and 9 have as sole purpose to relieve the pistons 8 and 9, the cross heads 4 and 5 and the crank mechanism from mechanical stresses. The gas pressure above the pistons has a high mean value—e.g. more than 10 MPa—and the conduit 14 with the receiver 15 ensures that the pressure variations in the two spaces 12 and 13 remain small. Therefore, the piston rings of the pistons 8, 9 will not be exposed to greater forces than necessary.

FIG. 2 shows an alternative embodiment of the power control device for a hot gas engine of the same type as the one shown in FIG. 1.

According to FIG. 2 the valve 35 has been provided with a hydraulic piston 50 to replace the solenoid of FIG. 1. The hydraulic piston 50 is influenced by oil which is supplied through a conduit 51 connected to a valve housing 52 in which a slide 53 has been arranged. Said slide 53 is influenced by bell crank masses 54 arranged on a shaft 55 which rotates at a speed in proportion to the engine speed. The valve housing 52 has connections 56 and 57 to the pressure side of a lub oil pump 58 and to an oil sump respectively. In case the engine speed suddenly increases substantially the slide 53 will be moved upwards and connect the pressure side of the pump 58 with the piston 50.

Any failure in the electric system of the device will not have any detrimental influence upon the safety against too high engine speeds of an engine provided with a power control device according to FIG. 2.

FIG. 3 shows the engine speed responsive control device 38 as functionally connected with different engine speed responses to control valves 29, 35 and 36.

What is claimed is:

1. In a power control device for maintaining a predetermined speed of a hot gas engine irrespective of the engine load and of the type in which the power output from the engine is governed by adjusting the amount of working gas in the engine having a control system signalling as a function of speed change a set of solenoid valves for controlling the pumping of working gas in a conduit system between the engine and a reservoir, the improvement comprising, a gas compressor having a suction stroke and pumping stroke coupled to the engine and reservoir through a branched conduit including (a) a check valve connecting the compressor with the reservoir to pump gas under pressure from the compressor into the reservoir and (b) power control means operating a one-way flow check valve admitting gas to the compressor from the engine on the suction stroke under control of a solenoid for keeping it open for gas flow in both directions when the engine is running at a predetermined constant speed and permitting it to function as a one-way flow check valve so that the compressor will pump gas to said reservoir when the speed increases above said predetermined speed.

2. The improvement defined in claim 1 wherein the engine power is provided by a reciprocating piston further having a short circuit connection for equalizing gas pressures on opposite sides of said piston controlled by a short circuit control valve actuated by a control circuit causing the short circuit connection to open with a sudden change of speed, with this last mentioned valve connected between said power control means check valve and the piston.

3. The improvement defined in claim 2 wherein the engine has an oil sump with a pump providing oil at a pressure varying with engine speed and the short circuit control valve is hydraulically controlled by the pressure of said oil.

4. The improvement defined in claim 1 wherein the conduit system from said reservoir consists of a first conduit from said reservoir through a solenoid controlled valve which opens to increase engine power when the engine speed lowers below said predetermined valve and through restrictors to opposite sides of said piston and a second conduit from the reservoir to said check valve.

* * * * *